United States Patent [19]

Lewin

[11] 4,203,116

[45] May 13, 1980

[54] MICROSTRIP ANTENNA RADIATORS WITH SERIES IMPEDANCE MATCHING MEANS

[75] Inventor: Leonard Lewin, Boulder, Colo.

[73] Assignee: International Standard Electric Corporation, New York, N.Y.

[21] Appl. No.: 933,308

[22] Filed: Aug. 14, 1978

[30] Foreign Application Priority Data

Sep. 15, 1977 [GB] United Kingdom ..... 38545/77

[51] Int. Cl.[2] ..... H01Q 1/38

[52] U.S. Cl. ..... 343/700 MS; 343/846

[58] Field of Search ..... 343/846, 700 MS, 854, 343/829

[56] References Cited

U.S. PATENT DOCUMENTS

| | | | |
|---|---|---|---|
| 4,063,245 | 12/1977 | James et al. | 343/700 MS |
| 4,079,268 | 3/1978 | Dickinson | 343/700 MS |

OTHER PUBLICATIONS

Lewin, L. "Radiation From Discontinuities In Strip--line" Proc. IEE, Part C, Sep. 1960, pp. 163–170.

*Primary Examiner*—David K. Moore

*Attorney, Agent, or Firm*—John T. O'Halloran; Alfred C. Hill

[57] ABSTRACT

One or more radiating elements are coupled to a source of microwave energy by one or more quarter-wave lines of alternately high and low characteristic impedance.

6 Claims, 14 Drawing Figures

MICROSTRIP ANTENNA RADIATORS WITH SERIES IMPEDANCE MATCHING MEANS

BACKGROUND OF THE INVENTION

This invention relates to microstrip antenna radiators.

A microstrip antenna radiator may be defined in general terms as one or more lengths of conductor strip which form(s) the radiating element(s) separated from yet parallel to a ground plane, the element(s) being fed from one end with microwave energy. Two forms of radiator are (a) a single element (end radiator), and (b) a so-called "comb" antenna in which a central feed conductor has on one side a plurality of right-angled half-wave side branches spaced at one wavelength intervals. A modification of the basic comb antenna has branches on both sides, the two sets of branches being staggered by one half-wavelength.

All discontinuities in microstrip radiate, either by intention or spuriously. Such elements as corners, T-junctions, open or closed circuits, as may occur in matching or phase-shifting networks, are encountered in antenna feed systems, and their unintended radiation will set a limit to the accuracy with which design radiation patterns can be achieved.

SUMMARY OF THE INVENTION

An object of the present invention is to provide a microstrip antenna radiator which makes full use of discontinuities in the feed system to enhance the desired radiation pattern.

A feature of the present invention is the provision of a microstrip antenna radiator comprising: at least one radiating element; an input for microwave energy; and a plurality of quarter-wave lines of alternately high and low characteristic impedance coupling the input to the element.

BRIEF DESCRIPTION OF THE DRAWING

Above-mentioned and other features and objects of this invention will become more apparent by reference to the following description taken in conjunction with the accompanying drawing, in which:

FIG. 9(*b*) illustrates a double-sided comb antenna;

FIG. 9(*c*) illustrates a matched comb antenna;

FIG. 10(*b*) illustrates the enhancement of radiation from an open circuit from the point of view of impedance matching; and FIG. 10(*c*) illustrates the enhancement of radiation from an open circuit from the point of view of stepped transformer matching.

DESCRIPTION OF THE PREFERRED EMBODIMENT

Figure 1:
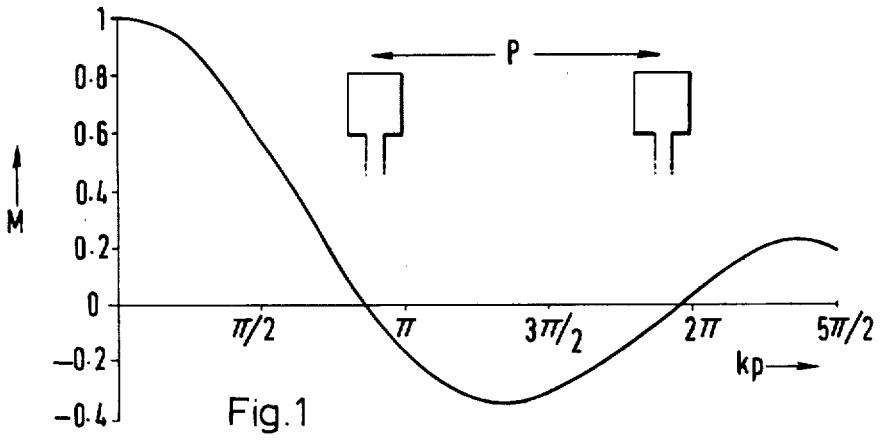
FIG. 1 illustrates mutual coupling of two equatorially displaced magnetic dipoles, normalized to zero displacement.

It is tempting to consider the radiation from, say, an open circuit in microstrip as coming out of the aperture at the end. If the strip is relatively wide it looks more like a conventional aperture, albeit a very thin one. Strictly speaking, an aperture calculation should involve the entire transverse plane in which the aperture is situated. If, as is commonly done, the contribution outside the aperture is ignored, this is because its effect is usually small compared to that from the aperture. It is primarily a question of aperture gain; if the gain is large the relative effect of the neglected field is small. If, on the contrary, the aperture is very small, its gain is not far from unity, and a calculation that neglects the remainder of the field in the transverse plane can give at best only a rough order-of-magnitude estimate. Moreover, if the form of the discontinuity is that of a corner or a T-junction, defining the relevant aperture is difficult. Thus, although it may be intuitively attractive to consider the radiation as if it comes from the location of the discontinuity, the concept is of limited use, and may even be misleading.

However, it is practical to consider the method used in "Radiation From Discontinuities In Strip-line", by L. Lewin, Proc. IEE, Part C, September 1960, pages 163–170, where the entire strip and polarization currents are integrated with suitable phase and distance factors, to evaluate the Hertz potential from which the fields may be found.

If the idea of radiation emerging from the discontinuity is an attractive one, then the idea of all the currents, from the discontinuity out to infinity, as contributing to the radiation is a little disconcerting. Why should the currents a long way from the aperture contribute? Mathematically, a Green's function formulation involves integration over a closed surface. If the surface is the entire transverse plane including the aperture we have the familiar aperture calculation.

If the surface is deformed so as to conform to the metal boundary, we have a conductor current type of formulation. If the formulation is rigorous, the two are numerically equal, though if approximations are made, one may be far more accurate than the other. The question of how far the currents need to taken really becomes one of accuracy. Beyond about a wavelength or so their effect is relatively small. This aspect can be made a little more precise by considering the example of the open-circuit discontinuity. In the above reference it was shown that its radiation pattern is similar to that of a magnetic dipole. The fields from two such dipoles spaced a distance $\rho$ in the same equatorial plane can be found from a potential of the form $e^{-jkr}/r$, where $k=2\pi/\lambda$ is the free-space wave number and r is distance. The mutual effect M for radiation comes from a consideration of the in-phase field component, and relative to its value at close spacing it can be written $$M=3/2\alpha[(1-1/\alpha^2)\sin\alpha+(1/\alpha)\cos\alpha] \quad (1)$$

where $\alpha=k\rho$.

A graph of this function is shown in FIG. 1. Up to about a sixth of a free-space wavelength spacing the mutual effect M is near unity. It then drops rapidly to zero, and oscillates with an amplitude that varies approximately as an inverse distance. It is fair to say that currents on the strip within about one third of the free-space wavelength from a discontinuity contribute substantially to the radiation.

There is a further sense in which one can contrast radiation effects as coming either from the discontinuity or from an ill-defined region in its vicinity. And the ambiguity really stems from the loose use of the word 'radiation', which could refer either to fieldstrength or to power flow. It is only at large distances from a radiator that the two become equivalent, with the Poynting vector proportional to the square of the fieldstrength in the far-field. A calculation of the potential involves an integration, and at a discontinuity, whether it be a termination or, say, a vertex of a zig-zag configuration, the form of the integrand changes. The integration process therefore involves an end contribution at that location. As far as the potential or the fields are concerned, it is as if there were a source with a phase-center at the discontinuity. This can be seen very clearly in the case of the half-wave dipole (with an assumed sinusoidal current). The Hertz potential is exactly the sum of two terms each of the form $e^{-jkr}/r$, with r measured from the dipole ends. But in what sense can we say that the dipole 'radiates' from its ends? The current is zero there, as is also the local value of the Poynting vector. The power in fact flows out of the feed at the dipole center, and is guided in an indirect fashion by the dipole to give the actual power pattern. It is clear that the ends act as if they were phase centers of radiation, but this is not equivalent to the statement that the dipole radiates from its ends. In the case of an open-circuit discontinuity in microstrip there is a similar phase-center for the radiated field, again located at the discontinuity. But as already discussed, currents on the strip (and the polarization beneath it) are substantial out to at least a third of the free-space wavelength away in contributing to the field. There is no clear-cut radiating aperture, even though the field phase-center is located at the end of the strip. Moreover, some energy emerges from the side of the strip to some distance back from the discontinuity so that the whole region really functions as an 'aperture'.

Figure 2:
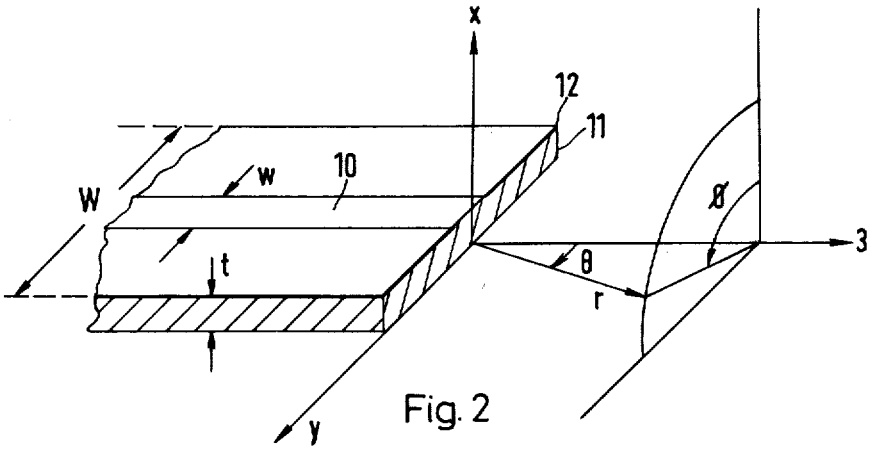
FIG. 2 illustrates a typical microstrip geometry.

In the above mentioned reference there is given below the expression for the Hertzian vector produced by a strip current $I(\zeta)$ and its associated effects, directed along the z-axis, as shown in FIG. 2. In FIG. 2 the strip conductor 10 is separated from a ground plane 11 by a thin dielectric sheet 12.

$$\Pi = \frac{-j30\overline{a_x}}{k} \int_{-\infty}^{\infty} \frac{e^{-jkr_o}}{r_o} \frac{\epsilon-1}{\epsilon} 2t \frac{\partial}{\partial\zeta} d\zeta - \frac{-j30\overline{a_z}}{k} \int_{-\infty}^{\infty} \left(\frac{e^{-jkr_1}}{r_1} - \frac{e^{-jkr_2}}{r_2}\right) I d \tag{2}$$

Here x, y and z are the coordinates of a field point, $\overline{a_x}$, $\overline{a_z}$ are unit vectors, and $$r_o = [x^2+y^2+(z-\zeta)^2]^{\frac{1}{2}}$$

$$r_{1,2} = [(x\mp t)^2+y^2+(Z-\zeta)^2]^{\frac{1}{2}}$$

$$\approx r_o \mp t\, x/r_o$$

$\epsilon$ = effective permittivity.

In the far field we can make standard approximations, leading to $$\Pi \sim \frac{-j60t}{k} \frac{e^{-jkr}}{r} \int_{-\infty}^{\infty} \left(\overline{a_x} \frac{\epsilon-1}{\epsilon} \frac{\partial I}{\partial\zeta} + \overline{a_z} jk \sin\theta \cos\phi\, I\right) e^{jk\zeta\cos\theta} d\zeta \tag{3}$$

Herein $r = x^2+y^2+z^2)^{\frac{1}{2}}$ is the distance from the origin to a field point.

In the far field the main components of the electric field are $$E_{74} = k^2 (\cos\theta \cos\phi\, \Pi_x - \sin\theta\, \Pi_z)$$

$$E_\phi = -k^2 \sin\phi\, \Pi_x \tag{4}$$

The Poynting vector is proportional to $|E_\theta|^2 + |E_\phi|^2$ and integration over the hemisphere $0<\theta<\pi$, $-\pi/2<\phi<\pi/2$ yields the radiated power. An example is given in the appendix of the above mentioned reference (wherein the first equation is in error through missing a factor $\sin\theta$ in the integrand).

We shall use these results here to examine a number of typical discontinuities, quoting results from the reference as needed.

Open Circuit

Quoting from equations (12) to (14) of the reference.

$$E_\theta = -j \frac{e^{-jkr}}{r} \frac{120\, kt}{\epsilon^{\frac{1}{2}}} \cos\phi \tag{5}$$

$$E_\phi = j \frac{e^{-jkr}}{r} \frac{120\, kt}{\epsilon^{\frac{1}{2}}} \frac{\epsilon-1}{\epsilon-\cos^2\theta} \cos\theta \cos\phi \tag{6}$$

$$P = 60\,(kt)^2 F_1(\epsilon) \tag{7}$$

$$F_1(\epsilon) = \frac{\epsilon+1}{\epsilon} - \frac{\epsilon-1}{2\epsilon^{3/2}} \log \frac{\epsilon^{\frac{1}{2}}+1}{\epsilon^{\frac{1}{2}}-1} \frac{8}{3\epsilon} \text{ for } \epsilon >> 1 \tag{8}$$

This is for a unit incident current wave, the reflection at the open circuit being assumed complete. For $\epsilon$ large equations (5) and (6) are similar to the field of a magnetic dipole. $E_\theta$ at $\phi=0$ is constant with $\theta$; $E_\phi$ at $\phi=\pi/2$, i.e. on the plane of the strip, takes the familiar figure of eight form, though with the loops elongated for smaller values of $\epsilon$.

The form of equation (7) is common to all the structures examined here, only the form-factor $F(\epsilon)$ varying from one to another. The value of $60(kt)^2$ at 4 GHz, $t=1/16''$ is 1.07, and the value of $F_1$ at $\epsilon=2.25$ is also 1.07. Thus, $P=1.15$, compared to $P=50$ in the incident wave if the line impedance is $Z_s=50$ ohms: 2.3% of the incident power is radiated. Since the radiation occurs near the end where the current is zero but the voltage is a maximum, the equivalent circuit can be represented by a large resistance $R_o$ at the end of the line. Its value is determined by $|V|^2/R_o=1.15$, and since $|V|=2Z_s$ for a unit incident current wave, we get $R_o=4Z_s^2/1.15$. A quarter wave in from the end this transforms to a series resistance $R=Z_s^2/R_o=1.15/4=0.29$ ohm.

Short Circuit

Equation (17) of the reference gives the formula for a general termination with a current reflection coefficient $Re^{j\Psi}$. With $R=1$, $\Psi=0$ a short circuit is obtained and gives $$E_\theta = 0 \tag{9}$$

$$E_\phi = \frac{-je^{-jkr}}{r} 120\, kt \frac{\sin^2\theta \sin\phi}{\epsilon - \cos^2\theta} \tag{10}$$

$P = 60(kt)^2 F_4$ with $$F_4 = \frac{3\epsilon - 1}{\epsilon} - \frac{(3\epsilon + 1)(\epsilon - 1)}{2\epsilon^{3/2}} \log \frac{\epsilon^{\frac{1}{2}} + 1}{\epsilon^{\frac{1}{2}} - 1} \sim \frac{16}{15\epsilon^2} \text{ for } \epsilon >> 1 \tag{11}$$

$F_4$ takes the value 0.246 at $\epsilon=2.25$. The complete absence of an $E_\theta$ component to the field is noteworthy. The $E_\phi$ component at the plane of the strip is similar to a figure of eight form but oriented at right angles to that from the open circuit.

Matched Termination

Equations (15) and (16) of the reference give $$E_\theta = -j \frac{e^{-jkr}}{r} \frac{60\, kt}{\epsilon^{\frac{1}{2}}} \cos\phi \tag{12}$$

$$E_\phi = j \frac{e^{-jkr}}{r} \frac{60\, kt}{\epsilon^{\frac{1}{2}}} \frac{\epsilon^{\frac{1}{2}} \cos\theta - 1}{\epsilon^{\frac{1}{2}} - \cos\theta} \sin\phi \tag{13}$$

$P = 60\,(kt)^2 F_2(\epsilon)$ with $$F_2(\epsilon) = \frac{\epsilon - 1}{2\epsilon^{\frac{1}{2}}} \log \frac{\epsilon^{\frac{1}{2}} + 1}{\epsilon^{\frac{1}{2}} - 1} \sim \frac{2}{3\epsilon} \text{ for } \epsilon >> 1 \tag{14}$$

$F_2$ takes the value 0.330 at $\epsilon=2.25$. In comparing it with the radiation from an open circuit it needs to be borne in mind that the reference in both cases is to a unit incoming current wave. Because of the reflection at the open circuit the peak voltage is doubled with respect to the matched case. For the same peak voltage the match radiates more.

Again the $E_\theta$ field is as from a magnetic dipole. The $E_\phi$ component at the plane of the strip is shown in the above mentioned reference. It is of figure of eight form, but with unequal loops, the fatter loop being in the direction opposite to the incident current wave.

Filter Section

The reference also gives the radiation when an unlimited line is shunted with an impedance Z. This gives rise to a reflected current wave of magnitude $\rho=Z_s/(Z_s+2Z)$. The $E_\phi$ field is given by equation (10) but multiplied by $\rho$. The power form factor is therefore given by equation (11) multiplied by $|\rho|^2$. If the impedance is from a shorting post then $Z=jX$ where X is the inductive reactance of the post. A pair of such posts approximately a half a strip wavelength apart constitute a filter resonator. As discussed in the reference, the loaded Q-factor is given approximately by $$Q_o \approx \pi Z_s^2/4X^2 \tag{15}$$

and the radiation form factor by $F_7=(Z_s^2/2X^2)\,F_4$. This formula ignores the mutual effect M between the posts, the modified connection between the radiation factor and the loaded Q being $$F_7' = (1+M)(2Q_o/\pi)F_4 \tag{16}$$

Thus, a fraction $F_7'/Z_s$ of the incident power is radiated, an estimation which is, of course, contingent on its being small. This clearly sets an upper limit to the Q-factor of a filter section in the line.

The value of M for use in equation (16) is not that from FIG. 1, which refers to open circuit ends. Rather, it is associated with $E_\phi$ at $\theta=0$ and $\pi$. From equation (10) the far field is zero at this position, so the value of M is likely to be quite small. But an accurate determination requires the exact near-field calculation for the short-circuit case.

Right-angle Corner

From equations (29) to (31) of the reference, $$E_\theta = -j \frac{e^{-jkr}}{r} \frac{60\, kt}{\epsilon^{\frac{1}{2}}} \left[ 1 + \frac{\cos\theta}{\epsilon^{\frac{1}{2}} - \sin\theta\cos\phi} \right] \cos\phi \tag{17}$$

$$E_\phi = j \frac{e^{-jkr}}{r} \frac{60\, kt}{\epsilon^{\frac{1}{2}}} \left[ \frac{(\epsilon - 1)\sin\phi}{\epsilon^{\frac{1}{2}} - \cos\theta} - \frac{(\epsilon - 1)\sin\phi + \epsilon^{\frac{1}{2}} \sin\theta \cos^2\phi}{\epsilon^{\frac{1}{2}} - \sin\theta\sin\phi} \right] \tag{18}$$

$P = 60(kt)^2 F_8(\epsilon)$ with $$F_8 = \frac{\epsilon + 1}{\epsilon^{\frac{1}{2}}} \log \frac{\epsilon^{\frac{1}{2}} + 1}{\epsilon^{\frac{1}{2}} - 1} - \frac{2\epsilon}{(2\epsilon - 1)^{\frac{1}{2}}} \log \frac{(2\epsilon - 1)^{\frac{1}{2}} + 1}{(2\epsilon - 1)^{\frac{1}{2}} - 1} \sim \frac{4}{3\epsilon}, \epsilon >> 1 \tag{19}$$

$F_8$ takes the value 0.61 when $\epsilon=2.25$, so the radiation is about double that from a matched termination.

The field pattern, given in the reference, is somewhat complicated. At the plane of the strip $E_\phi$ takes the form of a pair of loops pointing roughly in the z and y directions, the directions of the propagating current waves. In the plane $\phi=0$ the $E_\theta$ field is constant, and the $E_\phi$ field is the upper loop of a figure of eight pattern.

Change of Impedance

Figure 3:
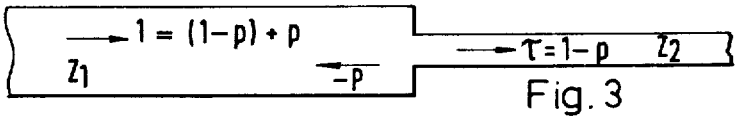
FIG. 3 illustrates a change of wave impedance.

FIG. 3 shows an unlimited line, changing impedance from $Z_1$ to $Z_2$ at $z=0$. At the junction there is a voltage reflection coefficient $$\rho=(Z_2-Z_1)/(Z_2+Z_1) \tag{20}$$

Associated with it there is a transmitted wave of transmission coefficient $\tau=1-\rho$. Since the current reflection coefficient is $-\rho$ we can consider the arrangement as a current wave $1-\rho$ from $-\infty<z<\infty$ and a current wave $\rho$ from $-\infty<z<0$ reflected at $z=0$. The radiation from the infinite line is zero, so the residual field is exactly that from an open circuit, but of amplitude $\rho$ with $\rho$ given by equation (20). Since a three-to-one step gives $\rho=\frac{1}{2}$, the radiation from such changes can clearly be an appreciable fraction of the open circuit radiation. The power is, of course, reduced by a factor $\rho^2$.

These considerations ignore the slight distortion of the current flow at the junction.

Side-arm Power Divider

Figure 4:
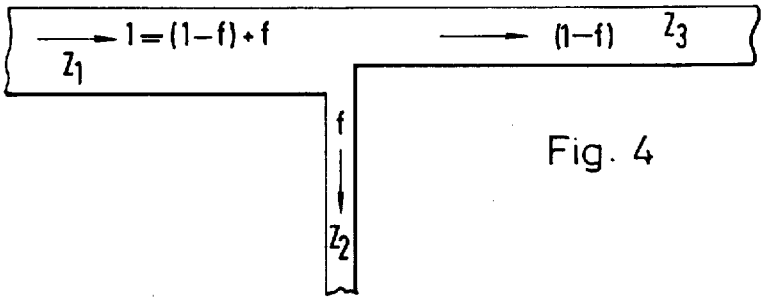
FIG. 4 illustrates a side-arm power divider.

FIG. 4 shows a line of impedance $Z_1$, a branch line of impedance $Z_2$, and a continuation arm of impedance $Z_3$. Power is divided in the ratio $(Z_3/Z_2)$ if it is assumed that the junction is matched. Apart from minor reactive effects, this requires $1/Z_1=1/Z_2+1/Z_3$. A fraction $f=Z_1/Z_2$ of a unit current wave incident at the junction from line $Z_1$ flows in the side arm, and a fraction $1-f=Z_1/Z_3$ flows in the continuation arm. The arrangement may be thought of as a current wave of amplitude $1-f$ from $-\infty<z<+\infty$, and a wave of amplitude f from $-\infty<z<0$ and from $0<y<+\infty$. Hence the arrangement behaves exactly as the right-angle corner previously discussed, but with the fields reduced in the ratio f:1 and the power radiation by a corresponding factor $f^2$. Thus, a 3 dB (decibels) power divider of this form radiates about a half that from a matched termination. A Y-divider has not been analyzed to date but its radiation is probably comparable, though possibly somewhat more.

Symmetrically-fed T-junction

Figure 5:
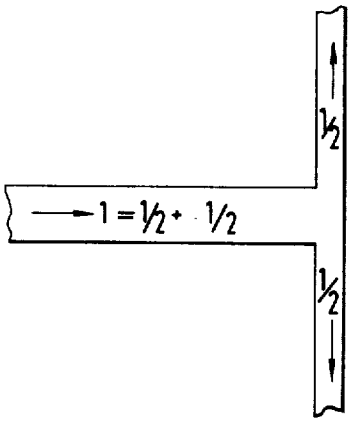
FIG. 5 illustrates a symmetrically-fed T-junction.

The arrangement is shown in FIG. 5. In order to ensure a match the center arm has half the characteristic impedance of the junction arms. Clearly the current divides equally into the junction, and the arrangement is equivalent, as far as the fields are concerned, to a pair of ring-angle corners, oppositely directed each carrying half the incident current.

As can be seen from FIG. 5, the structure is equivalent to two oppositely directed 90°-corners, each carrying half the incident current. The field can therefore be generated by the formulas (17) and (18) above in the following manner. For the $E_\theta$-component, write $-\phi$ for $\phi$, add the two results, and divide by two. For the $E_\phi$-component write $-\phi$ for $\phi$, subtract the two results and divide by 2. Alternatively, one can proceed from scratch, integrating from $-\infty<z<0$, $0<y<\infty$, and $-\infty<y<0$ to build up the Hertzian vector. This results in the far-field form $$\overline{\Pi}=-j60t\frac{e^{-jkr}}{r}\left\{\bar{a}_x\frac{\epsilon-1}{\epsilon^{\frac{1}{2}}}\left[\frac{1}{\epsilon^{\frac{1}{2}}-\cos\theta}-\frac{\epsilon^{\frac{1}{2}}}{\epsilon-\sin^2\theta\sin^2\phi}\right]+\bar{a}_y\frac{\sin^2\theta\sin\phi\cos\phi}{\epsilon-\sin^2\theta\sin^2\phi}-\bar{a}_z\frac{\sin\theta\cos\phi}{\epsilon^{\frac{1}{2}}-\cos\theta}\right\}$$

The electric far-field components are given by $$E_\theta=k^2\,[\cos\theta\cos\phi\,\Pi_x+\cos\theta\sin\phi\,\Pi_y-\sin\theta\,\Pi_z]$$

$$E_\phi=-k^2\,[\sin\phi\,\Pi_x-\cos\phi\,\Pi_y]$$

By either method one finds the expressions of equations (17) and (18).

Thus, it is shown that $$E_\theta=-j\frac{e^{-jkr}}{r}\,60\,kt\left[\frac{\cos\theta}{\epsilon-\sin^2\theta\sin^2\phi}+\frac{1}{\epsilon^{\frac{1}{2}}}\right]\cos\phi \tag{21}$$

$$E_\phi=j\frac{e^{-jkr}}{r}\,60\,kt\left[\frac{\cos^2\theta}{\epsilon-\sin^2\theta\sin^2\phi}+\frac{\epsilon^{\frac{1}{2}}\cos\theta-1}{\epsilon-\epsilon^{\frac{1}{2}}\cos\theta}\right]\sin\phi \tag{22}$$

Figure 6:
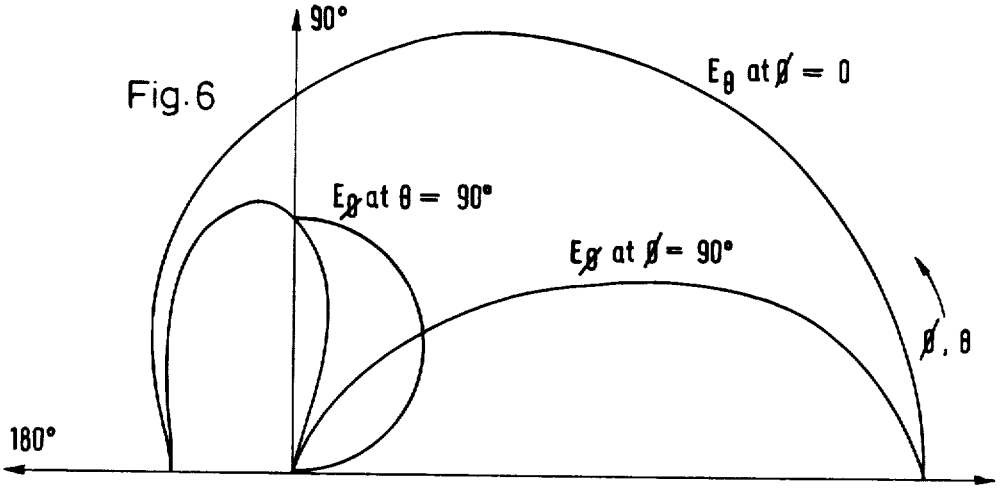
FIG. 6 illustrates the T-junction fields.

The form of the rather complicated field pattern is indicated in FIG. 6 for $\epsilon=2.25$. At $\phi=0$, $E_\theta$ has a major forward lobe, while $E_\phi$ at $\phi=90°$, i.e. on the plane of the strip, has a major forward lobe and a secondary broadside lobe. At $\theta=90°$, i.e. in the broadside plane, $E_\phi$ is zero at broadside, and rises to a maximum on the plane of the strip.

The calculation of the power radiation is somewhat complicated.

By forming $|E_\theta|^2+|E_\phi|^2$ and integrating over a hemisphere an expression for the radiated power is readily found. On putting $\tan\phi=\tau$ and $\cos\theta=c$ an expression for the form-factor $F_{10}$ results $$F_{10}=\frac{1}{2\pi}\int_{-\infty}^{\infty}\int_{-1}^{1}\left[\frac{1+\tau^2C^2}{(1+\tau^2)^2}+\frac{c^2(1+\tau^2c^2)}{[\epsilon+\tau^2(\epsilon-1+c^2)]^2}+2\frac{c+c^2\tau^2C}{(1+\tau^2)[\epsilon+\tau^2(\epsilon-1+c^2)]}\right]dc\,d\tau$$

where, $C=(\epsilon^{\frac{1}{2}}\cos\theta-1)/(\epsilon^{\frac{1}{2}}-\cos\theta)$.

The c-integrand is even except for a single term with c in the numerator; the latter therefore vanishes on integration.

The $\tau$-integration can be most readily achieved by contour integration over an infinite semicircle. The integrand has residues at j and $j[\epsilon/(\epsilon-1+c^2)]^{\frac{1}{2}}$ which are easily evaluated, leading to $$F_{10}=\int_{-1}^{1}\left[\frac{1+C^2}{4\epsilon}+\frac{c^2}{4\epsilon^{3/2}}\,\frac{\epsilon-1+(\epsilon+1)c^2}{(\epsilon-1+c^2)^{3/2}}+\frac{Cc^2}{1-c^2}\,\frac{\epsilon^{\frac{1}{2}}-(\epsilon-1+c^2)^{\frac{1}{2}}}{\epsilon^{\frac{1}{2}}(\epsilon-1+c^2)^{\frac{1}{2}}}\right]dc$$

All of the terms can now be readily reduced to standard forms, and equation (19) results. Note that the final numerator $\epsilon^{\frac{1}{2}}-(\epsilon-1+c^2)^{\frac{1}{2}}$ vanishes at $c=\pm1$, cancelling the corresponding $(1-c^2)$ in the demonimator. The integrand is therefore free of singularities in the range of integration.

Because of two equivalent right-angle corners are contiguous it is not adequate simply to add the powers radiated by the individual corners. Putting $P=60(kt)^2F_{10}$ it is found that $$F_{10}=\frac{(3\epsilon+1)^2}{8\epsilon^{3/2}}\log\frac{\epsilon^{\frac{1}{2}}+1}{\epsilon^{\frac{1}{2}}-1}-\frac{\epsilon}{(2\epsilon-1)^{\frac{1}{2}}}\log\left(\frac{\epsilon+(2\epsilon-1)^{\frac{1}{2}}}{\epsilon-(2\epsilon-1)^{\frac{1}{2}}}\right)-\frac{\epsilon+1}{4\epsilon} \tag{23}$$

For large $\epsilon$, $F\sim2/[3(\epsilon-2/5)]$. From the formulas (17), (18), (19) and (21), (22) and (23), the 3 dB side-arm power-divided has a form factor which for large $\epsilon$ behaves as $(4/3\epsilon)/4=\frac{1}{3}\epsilon$. Thus, the symmetrically fed T-junction radiates twice as much for large $\epsilon$. The value of F is 0.349 when $\epsilon=2.25$, contrasting to 0.150 for the side arm divider. The comparison is valid provided the center-arm of the T-junction and the incident-arm of the side-arm junction have the same characteristic impedance—this would normally be the case for a comparison.

Figure 7:
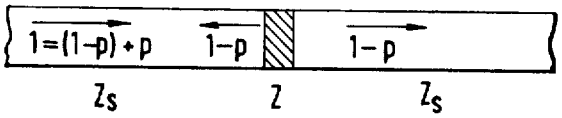
FIG. 7 illustrates series impedance in a microstrip line.

The arrangement is shown in FIG. 7, in which it is assumed that the impedance is of negligible extension. The representation could correspond to an actual impedance inserted into the line, or to an equivalent impedance representing, for example, the radiation resistance of another element such as an open circuit elsewhere in the line. The voltage reflection coefficient is $$\rho=Z/(Z+2Z_s) \tag{24}$$

and it is seen that an equivalent representation is a current wave from $-\infty<z<\infty$ of amplitude $1-\rho$, a current wave from $-\infty<z<0$ of amplitude $\rho$, and a reflected wave of amplitude $-\rho$. The structure radiates like an open circuit with an incident current of amplitude $\rho$. The power factor is accordingly $|\rho|^2F_1(\epsilon)$ with $F_1$ given by equation (8).

Summary of Results

The radiation from a discontinuity excited by a unit incident current wave is of the form $P=60(kt)^2F$, where the form factor F depends only on the effective dielectric constant $\epsilon$. F with various subscripts was calculated in the above-cited reference for a range of discontinuity types, and the range has been extended here. The following table summarizes the results, and gives F both for large $\epsilon$ and for $\epsilon=2.25$. The asymptotic form gives a fair idea of the values of F when $\epsilon$ is greater than about 3. As recorded earlier, the values of $60(kt)^2$ for a frequency of 4 GHz and a dielectric thickness of 1/16" is 1.07. The power should be referenced to that in a line with unit current wave, i.e. $P_o=Z_s$.

Table 1

| Discontinuity | Notation | Values of F: Equation | Large $\epsilon$ | $\epsilon = 2.25$ |
|---|---|---|---|---|
| Open Circuit | $F_1$ | 8 | $8/3\epsilon$ | 1.073 |
| Short Circuit | $F_4$ | 11 | $16/15\epsilon^2$ | 0.246 |
| Match | $F_2$ | 14 | $\frac{8}{3}\epsilon$ | 0.330 |
| 90° corner | $F_8$ | 19 | $4/3\epsilon$ | 0.610 |
| Impedance Change | $F_1\left(\frac{Z_2-Z_1}{Z_2+Z_1}\right)^2$ | Section 2.7 | $\frac{8}{3\epsilon}\left(\frac{Z_2-Z_1}{Z_2+Z_1}\right)^2$ | 0.268 (3 to 1 change) |
| Side-arm divider | $F_8\left(\frac{Z_3}{Z_2+Z_3}\right)^2$ | Section 2.8 | $\frac{4}{3\epsilon}\left(\frac{Z_3}{Z_2+Z_3}\right)^2$ | 0.152 (3 dB case) |
| T-junction | $F_{10}$ | 23 | $\frac{8}{3}\epsilon$ | 0.349 |
| Series Impedance | $F_1\left(\frac{Z}{Z+2Z_s}\right)^2$ | Section 2.10 | $\frac{8}{3\epsilon}\left(\frac{Z}{Z+2Z_s}\right)^2$ | 0.119 ($Z = Z_s$) |

Consider now the application of the foregoing to a microstrip antenna radiator.

The Comb Antenna

FIG. 1 gives the mutual effect M between two equatorially displaced magnetic dipoles, and is suitable for estimating the coupling between open-circuit like radiators along a microstrip line; for example the two ends of a half-wavelength resonator. If the radiators come from different lines, or branches from the same line, it is the mutual effect M for axial (side-to-side) displacement that may be needed. It comes from evaluating the real part of $(\partial^2/\partial y^2+k^2)\,je^{-jkr}/r$ at $r=y$, and relative to the value at $y=0$ can be written.

$$M=3\,(\sin\beta-\beta\cos\beta)/\beta^3, \tag{25}$$

where $\beta=ky$.

Figure 8:
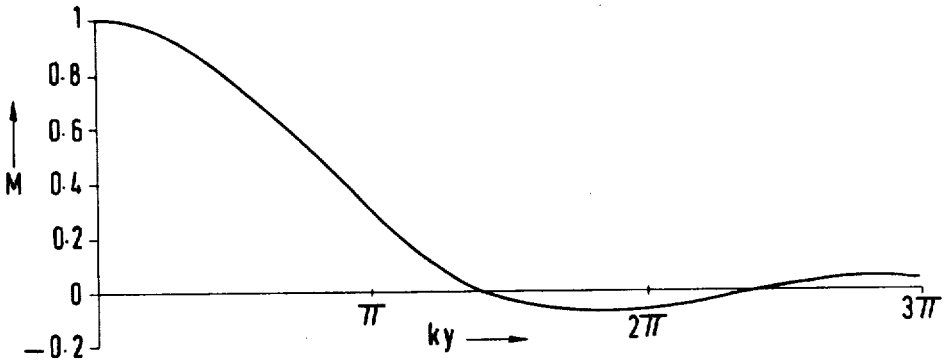
FIG. 8 illustrates the mutual coupling (resistive component) of two axially displaced magnetic dipoles, normalized to zero displacement.

This function is shown in FIG. 8, and is seen to be of substantial value out to about $ky=\pi$, after which it drops rapidly to zero and is negligible thereafter. For small displacements it is close to unity, leading to a doubling of the form factor for each radiator under such circumstances.

Figure 9:
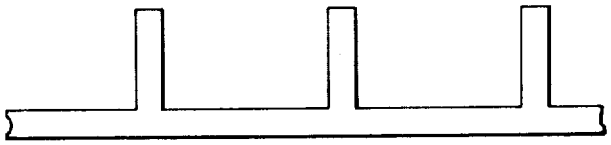
FIG. 9(*a*) illustrates a single-sided comb antenna.
Figure 9B:
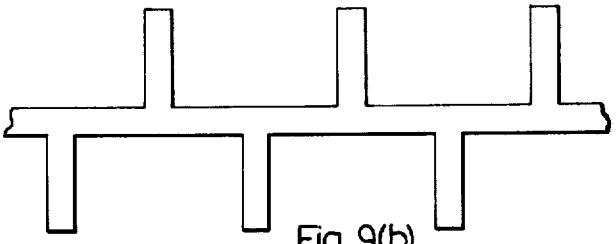

FIG. 9a shows one realization of a comb-antenna structure. It takes the form of a line with half-wave side branches at one wavelength (strip) separation. FIG. 9b is an alternative realization with side branches on alternate sides at half-wave separation. The 180° phase change due to the half-wave separation is compensated by the oppositely directed radiation field at the strip tip. Both antennas are broad-side radiators with a relatively wide equatorial beam, narrow bandwidth, and a frequency-dependent array maximum position.

The center-frequency properties of the array of FIG. 9a will be examined here from the point of view of estimating the disturbances to the simplified scheme of equal isolated radiators at the tips of the branch lines, with $\epsilon=2.25$, $f=4$ HGz and $t=1/16''$ assumed for the operational parameters.

For one wavelength (strip) separation, the value of ky to be used in FIG. 8 for the axial coupling is $2\pi/\epsilon^{\frac{1}{2}}=4\pi/3$, at which value M is almost zero. Note, however, that had the dielectric constant been much greater, say 9, for which M at $2\pi/3$ is 0.6, the mutual effect would have been substantial.

The resistance due to radiation at the end of an open circuit has already been estimated as about $10^4$ ohms, so the effect of one branch line in loading the feeder line is almost negligible. If we assume unit current wave in the feeder line the voltage amplitude at the branch line is $V=Z_f$, where $Z_f$ is the characteristic impedance of the feeder line. The same voltage appears at the tip of the branch line, with its characteristic impedance $Z_s$. The current in the branch line is therefore $I=(Z_f/Z_s)\sin k'z$, where $k'=k\epsilon^{\frac{1}{2}}$. This corresponds to a current wave of amplitude $Z_f/2Z_s$, incident on the tip, so the radiated power, in the absence of other effects, would be $60(kt)^2F_1\,(Z_f/2Z_s)^2$. However, the same current, but with opposite sign is also incident on the end connected to the feed line. The electric field, which also has the opposite sign, cannot emerge directly because of the metal surface of the feeder line, but it can emerge from the other side of the strip. It is, therefore, displaced by the width of the strip, but this is usually a negligible dimension. The result is that the side line acts as two in-phase radiators a half strip-wavelength apart. The mutual effect M for this combination is taken from FIG. 1, where its value at $k\rho=\pi/\epsilon^{\frac{1}{2}}=2\pi/3$ is 0.31. Both radiators add in-phase in the broadside direction, and the resultant total loading on the feed line is $$2\times(1+0.31)\times60(kt)^2F_1(Z_f/2Z_s)^2=0.76(Z_f/Z_s)^2.$$

If the value of $\epsilon$ had been 9 the mutual effects would have boosted the initial factor to 1.68, but $F_1$ would have decreased from 1.07 to 0.30, leading to an overall figure of 0.5. There are, thus, several factors to be considered in the total calculation. It might be added that the oblique mutual effects M, and also the mutual effects M from more distant radiators have been neglected in the above computation. The more general formula, for an axial separation y and an equatorial separation z, is $$M=3\{[1+\alpha^2(1-3/\gamma^2)/2]\sin\gamma-[1-3\alpha^2/2\gamma^2]\gamma\cos\gamma\}/\gamma^3, \quad (26)$$

where $\alpha=kz$, $\gamma=k(z^2+y^2)^{\frac{1}{2}}$. It reduces to equation (25) when $z=0$. When $kz=2\pi/3$, $ky=4\pi/3$, corresponding to the geometry of FIG. 9*a* when $\epsilon=2.25$, M takes the value $-0.083$. Its effect is almost negligible, as is that from the more distant radiators. (In making this calculation it has been assumed that $\epsilon$ is the same for both lines).

In the equatorial plane the power polar diagram is modified from uniformity by a factor $$\tfrac{1}{4}|1+\exp(jl/2\ k\lambda\epsilon^{-\frac{1}{2}}\cos\theta)|^2=\cos^2(\pi\epsilon^{-\frac{1}{2}}\cos\theta).$$

It is, of course, unity at $\theta=90°$ (broadside) where the two ends radiate in phase. For $\epsilon=2.25$ it drops to zero at $\theta=41°$, and exhibits a minor lobe with a peak at $\theta=0$ (along the strip) of value $\cos^2(\pi/\epsilon^{\frac{1}{2}})=0.25$. There is, therefore, an appreciable narrowing of the broadside beam, which may or may not be desirable, depending on the application. The narrowing, if unwanted, can be avoided by using a larger value of $\epsilon$.

In conclusion, we may summarize the situation for the comb-antenna by saying that, relative to the simplified assumption of isolated radiators at the side-arm tips, the more detailed analysis reveals (1) Both ends of the side arm radiate, substantially equal amounts.
(2) Mutual effects can be considerable.
(3) Feeder line loading may be several times that anticipated.
(4) The ratio of feeder to side-arm characteristic impedances gives an additional control on the loading.
(5) The broadside radiation is narrowed by an amount depending on the dielectric constant. This narrowing may be considerable.
(6) Since the effective dielectric constant varies with the line width and, therefore, the characteristic impedance, this will have its effect on the calculation of the mutual effects M and should be allowed for in a more refined calculation.
(7) The total loading can be substantial. Thus, if $Z_f=120$ ohm and $Z_s=30$ ohm, the loading per side arm is about $120^2/12$ ohms, so a device only five strip wavelengths long of the structure of FIG. 9*b* apparently would be matched.
(8) Such substantial loading requires additional attention, since the effect of loading has so far been neglected. The method of going this is considered in detail below for the stepped transformer radiator, where it is discovered that matching, in that configuration, actually halves the net loading. This is directly connected with the halving of the voltage amplitude on the line due to the absence of any reflected wave. Since the power is proportional to the square of the voltage, the loading, in the absence of further effects, would be quartered. This effect is apparently absent in the case of the comb antenna considered here, since the assumption has been made that the feeder line is terminated in a matched load. This would not be needed if the side arms matched the feeder, but then there would be an end reflection which would double the feeder voltage. When squared this cancels the above-mentioned quartering. The 120 ohm input can be matched to, say, at 50 ohm line with a quarter-wave transformer of 77 ohm impedance.

Figure 9C:
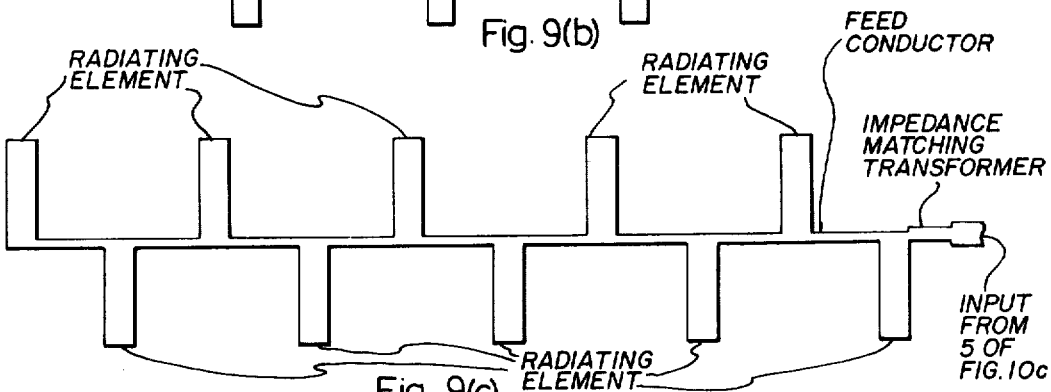

The modified device is shown in FIG. 9c.

The Matched Strip-End Radiator

Figure 10A:
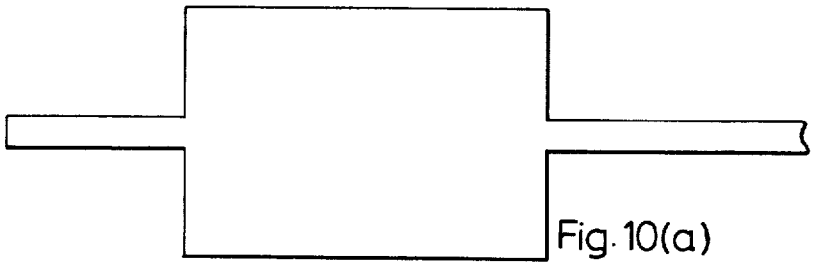
FIG. 10(*a*) illustrates the enhancement of radiation from an open circuit from the point of view of negative radiation suppression.
Figure 10B:
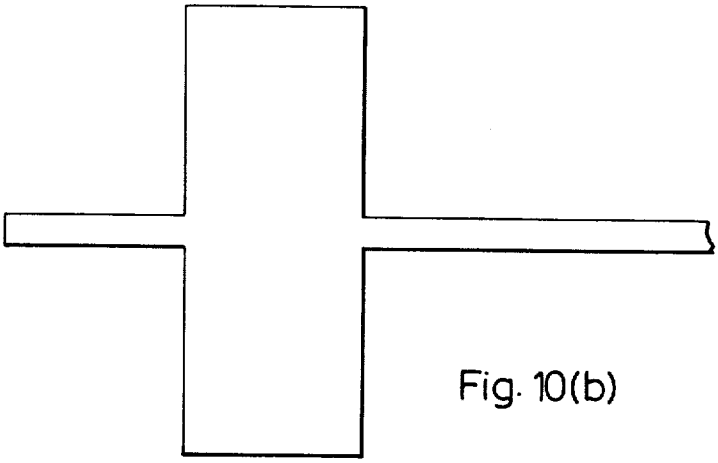
Figure 10C:
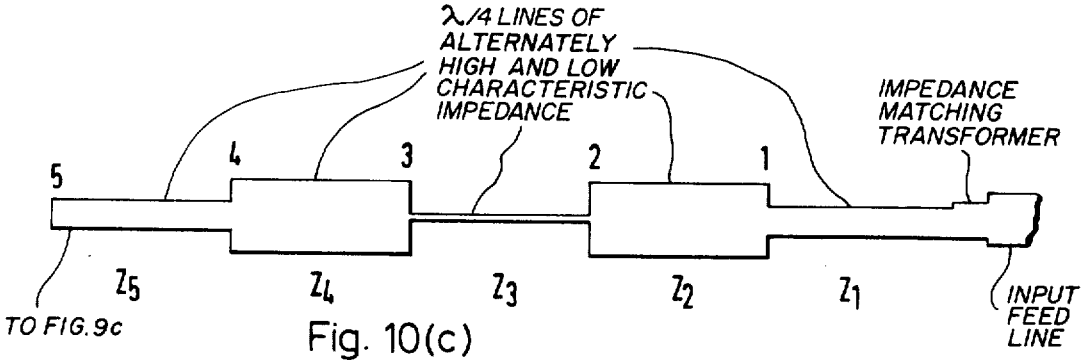

By way of example we shall examine this structure from the point of view of the operational parameters $\epsilon=2.25$, $t=1/16''$, $f=4$ GHz. This gives a value for $60(kt)^2F_1$ of 1.148. As explained earlier this leads to only a few percent radiation of the incident power. For a unit incident current wave the voltage amplitude at the strip end is $2Z_s$, so the effective loading resistance at the end of the line is $4Z_s^2/1.148$. This is of the order of $10^4$ ohm for $Z_s=50$, and is clearly too large to match to with a tapered transformer. A sequence of quarter wave transformers, such as shown in FIG. 10c, is suitable for impedance matching of the input feed line to the antenna array of FIGS. 9(*a*), 9(*b*) or 9(*c*), but there is still a practical requirement of keeping both the high and low values within bounds. If we set, as an example, a factor 2 above and below a value of $Z_5=50$ ohm, we have the following sequence. At position 5 a resistance of $4.50^2/1.148=8700$ accounts for the radiation, and is transformed to $50^2/8700=0.29$ ohm at position 4. With $Z_4=25$ this transforms to $25^2/0.29=2160$ ohms at 3, transforming again to $100^2/2160=4.64$ ohms at 2, and $25^2/4.64=135$ ohms at 1. A further quarter wave transformer of 82 ohm characteristic impedance, brings this to 50 ohm, apparently matching the feed line at that point. Alternatively, new values for $Z_2$ and $Z_4$ of 20 ohm, and $Z_1$ of 105 ohm will match directly to 50 ohm. At this point it is not worth going more closely into the matching because two additional features intrude. The first, as discussed briefly earlier, is the subsidiary radiation at the impedance changes, namely, at positions 1 to 4. The second is the now-trivial corrections due to the radiation. The reflection in a 50 ohm line of a 8700 ohm termination yields a negligible change to the radiation, but by the time this has been transformed into a match, or near match, the effect clearly must be substantial. We shall consider these alterations separately, finding first the effect of the subsidiary radiators in the absence of loading, and then the modification to them required by the loading effects of the radiation itself.

We use the notation $I_5$ for the current in the section between positions 4 and 5, $I_4$ for the current between positions 3 and 4, and so on, with $I_1$ the current on the feed line. Since the end is taken as an open circuit, consecutive junctions are open or short circuits, and we can take $$I_1=\sin k'z,\ I_2=A\sin k'z,\ I_4=I_5=B\sin k'z \quad (27)$$

where A and B are amplitudes to be determined by matching at positions 1 and 3. (The equality of the currents at positions 2 and 4 follows from current continuity there). Since the voltages are proportional to the derivative of the current times the respective wave impedances we get $$Z_1=Z_2A,\ Z_3A=Z_4B \quad (28)$$

giving $$A=Z_1/Z_2,\ B=Z_1Z_3/Z_2Z_4 \quad (29)$$

This enables the total current to be written in the compact form $$I=-\tfrac{1}{2}je^{-jk'z}[1, A, A, B, B]-(-\tfrac{1}{2}j)e^{jk'z}[1,A,A,B,B] \quad (30)$$

with A and B given by equation (29).

The notation in the brackets means that the current amplitude takes the designated value in the corresponding position.

Now |1,A,A,B,B| can be written as the sum of three sequences, $$[1,A,A,B,B]=[B,B,B,B,B]+[A-B,A-B,A-B,0,0]+[1-A,0,0,0,0] \quad (31)$$

i.e. a current amplitude B all the way to position 5, an amplitude A−B up to position 3, and an amplitude 1−A up to position 1. This means the line operates as three open circuit radiators at positions 1, 3 and 5, with amplitudes 1−A, −(A−B) and B. The negative sign in the middle radiator comes from the change of sign of sin k'z when k'z changes by a half strip wavelength.

Now $A=Z_1/Z_2=50/25=2$, and $B=Z_1Z_3/Z_2Z_4=50.100/25^2=8$, so the respective amplitudes are (to this order of approximation) −1, 6 and 8. Since the radiated powers are proportional to the amplitudes squared, we may anticipate that the radiation at positions 5 and 3 will be appreciable, and at the remaining positions it will be negligible. Moreover, since the match improves as we approach position 1 from position 5, it may be expected that the relative radiation at positions 5 and 3 will not be much altered, there will be some small additional radiation from positions 4 and 2, and that at position 1 may be reduced, when the radiative loading is allowed for.

To consider the loading we account for the radiation of the strip end by a small series resistance inserted at position 4, where it will (approximately) transform into a large (2160 ohm) loading at position 3. The loading of the radiator at position 3 will similarly be a large loading at this position, so both the expected substantial radiators in the system can be taken into account by this one loading, of a suitable value, at position 3, or alternatively, a corresponding small series loading at position 4. Since it is the series loading that should be considered, so we now investigate the circuit of FIG. 10(c), with a series loading $\bar{R}$ at position 4.

We take the currents in the form $$I_5=A\sin k'z$$

$$I_4=A\sin k'z+B\cos k'z$$

$$I_3=C\sin k'z+B\cos k'z$$

$$I_2=C\sin k'z+D\cos k'z$$

$$I_1=E\sin k'z+D\cos k'z \quad (32)$$

(Note that A and B are no longer given by equation (29). This form ensures current continuity at $z=-n\lambda'/4$ with n=1,2,3,4.

At position 4, $z=-\lambda'/4$, we need $V_4-V_5=\bar{R}I_5$, and at positions 1, 2 and 3 we need continuity of $Z\partial I/\partial z$. This leads to the values $$B=jA\bar{R}/Z_4$$

$$C=AZ_4/Z_3$$
$$D=jA\bar{R}Z_3/Z_2Z_4$$
$$E=AZ_2Z_4/Z_1Z_3 \quad (33)$$

Accordingly, using the previously introduced bracket notation, the total current can be written $$I=-\tfrac{1}{2}je^{-jk'z}[E-jD, C-jD, C-jB, A-jB, A]-(-\tfrac{1}{2}j)e^{jk'z}[E+jD, C+jD, C+jB, A+jB, A] \quad (34)$$

with B, C, D and E given in terms of A (still arbitrary) from (33).

The brackets can be broken up into a sequence of terms which individually exist from the feed line up to the designated position. The latter will now be indicated by a subscript on the current amplitude. Thus, $B_4$ means that the current exists all the way up to position 4, and is of amplitude B.

It is found that $$I=A_5\sin k'z+B_4\sin k'(z+\lambda'/4)+(A-C)_3\sin k'(z+\lambda'/2)+(B-D)_2\sin k'(z+3\lambda'/4)+(E-C)_1\sin k'(z+\lambda') \quad (35)$$

The notation is aided by the form in which the trigonometrical terms are put, e.g. $(A-C)_3\sin k'(z+\lambda'/2)$ means a sine wave of amplitude A−C terminating at position 3, where $z=-\lambda'/2$. Clearly the arrangement corresponds to a sequence of open-circuit radiators from positions 1 to 5 of respective amplitudes $$(E-C), (B-D), (A-C), B, A.$$

Referring now all amplitudes to a unit incident current wave at position 1, we need D+jE=2, whence A is determined from equation (33) by $$A=-2j\Big/\left[\frac{Z_2Z_4}{Z_1Z_3}+\frac{\bar{R}Z_3}{Z_2Z_4}\right] \quad (36)$$

For a match we need $\bar{R}=Z_2^2Z_4^2/Z_1Z_3^2$. If we allow for a possible mis-match by introducing a parameter $\beta$ such that $$\bar{R}=\beta Z_2^2Z_4^2/Z_1Z_3^2 \quad (37)$$

then $\beta=1$ designates the matched condition.

From equation (35) the radiators all radiate in the equatorial plane with the indicated amplitudes, leading to a field at $\theta=\pi/2$ whose amplitude is boosted, relative to that from a unit incident current wave at position 5 only, by a factor $$F=\frac{1}{1+\beta}\left(\frac{2Z_1(Z_3-Z_4)}{Z_2Z_4}+1-j\beta\frac{(Z_3-2Z_2)}{Z_3}\right) \quad (38)$$

Note that $\beta=1$, a match, halves the initial amplitude factor.

As an example, with $Z_1=50$, $Z_2=Z_4=25$ and $Z_1=100$, the amplitudes of the radiators from positions 1 to 5 are, under matched conditions, $-\frac{1}{2}$, $-j\frac{3}{8}$, 3, j/8, 4, respectively. Compared to the estimations, in the absence of loading, of −1, 0, 6, 0, 8 we see that the loading has halved the original amplitudes, and introduced small quadrature components at positions 2 and 4. The factor F in equation (38) becomes 6.5−j/4 so $|F|^2=42.5$. This is not enough to achieve a match with the original figures, but, as we shall see, there are some substantial additions still to be made.

If M is the mutual effect, obtainable from FIG. 1, then the value of R, due to the radiator of amplitude A−C at position 3, is increased to $R_1$ according to the relation $AR_1=AR+MR(A-C)$, or $R_1=R+MR(1-C/A)$. Similarly the radiator at position 3 has its effect increased to R' where $(A-C)R'=(A-C)R+MRA$ or $R'=R+MR/(1-C/A)$. The equivalent resistance that R' puts into the circuit, relative to that of R, in the absence of mutual effects, is reduced by the factor $(A-C)^2/A^2$, so the resistance actually inserted by it is $R_2=(1-C/A)^2[R+MR/(1-C/A)]$. The total effective series resistance is therefore $\bar{R}=R_1+R_2=R[1+(1-C/A)^2]+2MR\ (1-C/A)$. Putting in the value of C/A from equation (33) gives $$\bar{R}=R\{1+(1-Z_4/Z_3)^2+2M(1-Z_4/Z_3)\} \quad (39)$$

With $R=0.29$, $Z_4=25$, $Z_3=100$ and $M_2=0.31$ the value of $\bar{R}$ is found to be 0.585. Hence, $|F|^2\bar{R}=25$. F needed for a match to a 50 ohm line is, of course, 50, so a further increase of two to one is needed, via a decrease of the ratio $Z_4/Z_3$. Decreasing $Z_4/Z_3$ increases $\bar{R}$ slightly in equation (39), but its major effect is in equation (37) via $Z_2^2Z_4^2/Z_3^2$. Thus, if we choose new values of $Z_2=Z_4=21$ ohm, $Z_3=105$ ohm, the first factor increases by 1.06 and the second by 1.92. Between them they produce the needed two to one increase.

The above analysis ignores the mutual effects from the relatively small radiation from positions 1, 2 and 4, though they clearly will have a minor though noticeable effect on the field pattern off broadside. An array, of course, will introduce further mutual effects, as studied above in considering the comb antenna, and will further modify the values needed. An additional refinement, not covered here, is the change in effective dielectric constant of the lines as a function of characteristic impedance. This will both alter, slightly, the end-effect for quarter-wave operation, and also change the line wavelength. The changed separation will have secondary effects on the mutual effects. In general, the lower impedance lines have higher effective dielectric constants, and are physically shorter due to both the end effects and the reduced line wavelength. Thus, the mutual effect between positions 3 and 5, calculated above, will be a little on the low side, enabling some further small adjustments to be made in the direction of lowering $Z_3$ and/or increasing $Z_2$.

It is interesting to note that the final figures for $Z_2$, $Z_4$ and $Z_3$ are not far from the crude estimates at the beginning of the section, but that substantial cancellation of effects occurs to achieve this. The details would be different for a different dielectric constant, and the acknowledgement that position 3 is a non-trivial contributory radiator is important. For example, if the main feed structures were in a shielded line environment, position 3 would be unable to radiate and the effective radiative loading would be about halved, leading to an unanticipated 2 to 1 input mismatch.

In summary, we may say that both the mutual impedances and the line impedance changes must be allowed for, and that matching at the feed input is achieved at the 'cost' of halving the anticipated loading. Supplementary radiators are brought into existence at the positions of the impedance changes, and at least the one nearest the strip end has a non-negligible effect on the loading and is responsible for sharpening the broadside field pattern. When these changes are taken into consideration the resulting radiator should be matched (at center frequency) to the line.

While I have described above the principles of my invention in connection with specific apparatus it is to be clearly understood that this description is made only by way of example and not as a limitation to the scope of my invention as set forth in the objects thereof and in the accompanying claims.

I claim:

1. A microstrip antenna arrangement comprising:
at least one microstrip half wave length radiating element;
an input microstrip feed line for microwave energy; and
a quarter-wave microstrip line comprising a series of rectangular patches of alternately narrow and wide widths to provide alternating high and low characteristic impedance and said patches being connected in series between said input line and said element, said plurality of patches providing an impedance match between said input line and said element.

2. An arrangement according to claim 1, wherein said element includes
a plurality of radiating elements which are half-wave branches extending at right angles to a feed conductor coupled in series to an adjacent end of said plurality of patches, said branches each having a first characteristic impedance and being spaced at intervals of one wavelength along said feed conductor which has between successive branches a second higher characteristic impedance.

3. An arrangement according to claim 2, further including
a second plurality of branches identical to said first plurality of branches, said first plurality of branches being disposed on one side of said feed conductor and said second plurality of branches being disposed on a side of said feed conductor opposite said first plurality of branches, said first and second plurality of branches being staggered relative to each other by one half-wavelength along said feed conductor.

4. An arrangement according to claim 2, further including
a quarter-wave line having a third characteristic impedance acting as an impedance matching transformer between said adjacent end of said plurality of patches and said feed conductor.

5. An arrangement according to claim 4, further including
a second plurality of branches identical to said first plurality of branches, said first plurality of branches being disposed on one side of said feed conductor and said second plurality of branches being disposed on a side of said feed conductor opposite said first plurality of branches, said first and second plurality of branches being staggered relative to each other by one half-wavelength along said feed conductor.

6. An arrangement according to claim 1, wherein said element is a half-wave line radiating at one end thereof, the other end of said half-wave line having a first characteristic impedance and coupled to an adjacent end of said plurality of patches, said adjacent end of said plurality of patches having a second characteristic impedance lower than said first characteristic impedance.

* * * * *